US011319824B2

(12) United States Patent
Hoell et al.

(10) Patent No.: US 11,319,824 B2
(45) Date of Patent: May 3, 2022

(54) ROTOR WITH CENTRIFUGALLY OPTIMIZED CONTACT FACES

(71) Applicant: Siemens Energy Global GmbH & Co. KG, Munich (DE)

(72) Inventors: Harald Hoell, Wachtersbach (DE); Kevin Kampka, Mülheim a. d. Ruhr (DE); Peter Schröder, Essen (DE)

(73) Assignee: Siemens Energy Global GmbH & Co. KG, Munich (DE)

( * ) Notice: Subject to any disclaimer, the term of this patent is extended or adjusted under 35 U.S.C. 154(b) by 0 days.

(21) Appl. No.: 17/044,828

(22) PCT Filed: Apr. 16, 2019

(86) PCT No.: PCT/EP2019/059727
§ 371 (c)(1),
(2) Date: Oct. 1, 2020

(87) PCT Pub. No.: WO2019/211091
PCT Pub. Date: Nov. 7, 2019

(65) Prior Publication Data

US 2021/0095568 A1 Apr. 1, 2021

(30) Foreign Application Priority Data

May 3, 2018 (EP) ..... 18170613

(51) Int. Cl.
*F01D 5/30* (2006.01)
*F01D 11/00* (2006.01)
(Continued)

(52) U.S. Cl.
CPC ..... *F01D 11/006* (2013.01); *F01D 5/3015* (2013.01); *F01D 5/081* (2013.01);
(Continued)

(58) Field of Classification Search
CPC ..... F01D 5/3015; F01D 5/3007; F01D 5/326; F01D 5/081; F01D 11/006
See application file for complete search history.

(56) References Cited

U.S. PATENT DOCUMENTS 3,455,537 A * 7/1969 Ciavola ..... F01D 5/3015 415/134
3,572,966 A * 3/1971 Borden ..... F01D 5/081 416/95
(Continued)

FOREIGN PATENT DOCUMENTS

EP 1944471 B1 9/2009
EP 2414641 B1 7/2013
(Continued)

OTHER PUBLICATIONS

PCT International Search Report and Written Opinion of International Searching Authority dated Jul. 25, 2019 corresponding to PCT International Application No. PCT/EP2019/059727 filed Apr. 16, 2019.

*Primary Examiner* — Woody A Lee, Jr.
*Assistant Examiner* — Behnoush Haghighian

(57) ABSTRACT

A rotor for a gas turbine having a rotor disk on which there are a plurality of rotor components distributed around the circumference. The rotor disk has a circumferential securing shoulder with a contact face. Retaining faces come to bear against the contact face, each of the retaining faces have a retaining shoulder of the respective rotor component and are designed with a form that complements the contact face. In order to optimize the bearing stresses between the retaining shoulder and the securing shoulder, the retaining face has a smaller radius than the contact face, namely the retaining radius is at least 0.99 times and at most 0.995 times the contact radius. Also provided is an axially extending aperture in the rotor component, the width of which in the
(Continued)

circumferential direction is 25% to 75% of the rotor component width in the circumferential direction.

18 Claims, 2 Drawing Sheets

(51) Int. Cl.
*F01D 5/32* (2006.01)
*F01D 5/08* (2006.01)

(52) U.S. Cl.
CPC ..... *F01D 5/3007* (2013.01); *F01D 5/326* (2013.01); *F05D 2220/32* (2013.01); *F05D 2240/24* (2013.01)

(56) References Cited

U.S. PATENT DOCUMENTS 3,853,425 A * 12/1974 Scalzo ..... F01D 5/18 416/95
4,171,930 A * 10/1979 Brisken ..... F01D 5/3015 416/220 R
4,304,523 A * 12/1981 Corsmeier ..... F01D 5/3015 29/889.21
4,480,959 A * 11/1984 Bourguignon ..... F01D 5/26 416/145
4,803,893 A * 2/1989 Bachinski ..... F01D 5/027 415/119
4,875,830 A 10/1989 Trousdell et al.
5,143,512 A * 9/1992 Corsmeier ..... F01D 5/082 415/115
5,236,302 A * 8/1993 Weisgerber ..... F01D 11/001 415/173.7
5,275,534 A * 1/1994 Cameron ..... F01D 11/006 416/220 R
5,333,993 A * 8/1994 Stueber ..... F01D 11/025 415/174.5
5,445,499 A * 8/1995 Charbonnel ..... F01D 5/3015 416/220 R
5,472,313 A * 12/1995 Quinones ..... F01D 5/082 415/115
5,816,776 A * 10/1998 Chambon ..... F01D 5/066 415/174.5
5,954,477 A * 9/1999 Balsdon ..... F01D 5/3015 416/95
6,106,234 A * 8/2000 Gabbitas ..... F01D 5/3015 416/220 R
6,488,473 B1 * 12/2002 Lee ..... F01D 5/3015 416/204 A
6,884,028 B2 * 4/2005 Brauer ..... F01D 5/3015 415/173.7
7,040,866 B2 * 5/2006 Gagner ..... F01D 5/3015 416/220 R
7,371,050 B2 * 5/2008 Pasquiet ..... F01D 5/3015 416/204 A
7,484,936 B2 * 2/2009 Bouchard ..... F01D 5/3015 416/193 R
7,500,832 B2 * 3/2009 Zagar ..... F01D 5/3015 416/220 R
7,566,201 B2 * 7/2009 Brillert ..... F01D 5/081 29/889.2
8,007,230 B2 * 8/2011 Hafner ..... F01D 5/08 415/173.7
8,226,366 B2 * 7/2012 Brucher ..... F01D 5/3015 416/221
8,459,953 B2 * 6/2013 Haffner ..... F01D 11/006 416/220 R
8,608,436 B2 * 12/2013 Wines ..... F01D 5/066 415/174.2
8,888,460 B2 * 11/2014 Ahaus ..... F01D 5/323 416/220 R
8,894,371 B2 * 11/2014 Ahaus ..... F01D 5/323 416/220 R
8,920,121 B2 * 12/2014 Dungs ..... F01D 11/006 416/97 R
9,109,457 B2 8/2015 Ahaus et al.
9,151,170 B2 * 10/2015 El-Aini ..... F01D 5/147
10,066,485 B2 * 9/2018 Willett, Jr. ..... F01D 11/003
10,196,916 B2 * 2/2019 Matthews ..... F01D 5/02
10,280,766 B2 * 5/2019 Deighton ..... F01D 5/3015
10,309,234 B2 * 6/2019 Hoell ..... F01D 5/3015
10,378,367 B2 * 8/2019 Hoell ..... F01D 5/3015
10,458,258 B2 * 10/2019 Sandoval ..... F01D 5/082
10,557,356 B2 * 2/2020 Wines ..... F01D 5/3007
10,563,526 B2 * 2/2020 Kang ..... F01D 5/02
10,774,666 B2 * 9/2020 McCaffrey ..... F01D 11/005
2004/0062643 A1 * 4/2004 Brauer ..... F01D 5/3015 415/173.7
2005/0271511 A1 * 12/2005 Pasquiet ..... F01D 5/3015 416/220 R
2008/0008593 A1 * 1/2008 Zagar ..... F01D 5/3015 416/220 R
2008/0181767 A1 * 7/2008 Brillert ..... F01D 5/081 415/170.1
2008/0181768 A1 * 7/2008 Brucher ..... F01D 5/3015 415/170.1
2010/0196164 A1 8/2010 Liotta et al.
2011/0206524 A1 8/2011 Bilstein et al.
2012/0034087 A1 * 2/2012 Dungs ..... F01D 5/3015 416/219 R
2012/0039719 A1 * 2/2012 Ahaus ..... F01D 5/323 416/220 R
2012/0128504 A1 * 5/2012 Ahaus ..... F01D 5/323 416/97 R
2016/0222799 A1 8/2016 Dungs et al.
2016/0265378 A1 9/2016 Dungs et al.
2017/0022818 A1 1/2017 Weinert et al.
2017/0037736 A1 * 2/2017 Dungs ..... F01D 5/3015
2017/0096903 A1 * 4/2017 Schiessl ..... F01D 5/081
2017/0191371 A1 * 7/2017 Dungs ..... F01D 11/003
2017/0204732 A1 * 7/2017 Hoell ..... F01D 5/3015
2017/0211397 A1 * 7/2017 Hoell ..... F01D 5/3015
2017/0241284 A1 * 8/2017 Hoell ..... F01D 5/3015
2018/0023401 A1 * 1/2018 Hoell ..... F01D 5/3015 416/220 R

FOREIGN PATENT DOCUMENTS

EP 2344723 B1 5/2014
EP 2426315 B1 10/2014
EP 2399004 B1 3/2015
EP 2975218 A1 1/2016
EP 3015656 A1 5/2016
EP 3019706 A1 5/2016
EP 3071795 A2 9/2016
EP 3090135 A2 11/2016
EP 3129599 A1 2/2017
EP 3129600 A1 2/2017
EP 3167163 A1 5/2017
EP 3227532 A1 10/2017
EP 3077627 B1 11/2017
JP H07103807 B2 11/1995
JP 2001198906 A 7/2001
JP 2010180879 A 8/2010
WO 2015051956 A1 4/2015
WO 2015071070 A2 5/2015
WO 2015158542 A1 10/2015
WO 2015165678 A2 11/2015
WO 2016008789 A1 1/2016
WO 2016008791 A1 1/2016
WO 2016066394 A1 5/2016
WO 2016134864 A1 9/2016
WO 2017174355 A1 10/2017
WO 2017174723 A1 10/2017

* cited by examiner

ROTOR WITH CENTRIFUGALLY OPTIMIZED CONTACT FACES

CROSS REFERENCE TO RELATED APPLICATIONS

This application is the US National Stage of International Application No. PCT/EP2019/059727 filed 16 Apr. 2019, and claims the benefit thereof. The International Application claims the benefit of European Application No. EP18170613 filed 3 May 2018. All of the applications are incorporated by reference herein in their entirety.

FIELD OF INVENTION

The invention relates to a rotor having a rotor disk and a plurality of rotor components attached circumferentially to the rotor disk, the rotor disk having a support surface facing toward the rotor axis, and the respective rotor component having a retaining surface complementary to the support surface.

BACKGROUND OF INVENTION

A great variety of possibilities for attaching rotor components to rotor disks are known from the prior art. Thus, for example, EP 1944471 B1 discloses a rotor having a rotor disk on which a plurality of sealing elements are arranged on an end face. The rotor disk in this case has a plurality of blade retaining slots distributed around its circumference, which are designed to accommodate the rotor blades. To cover the blade retaining slots on an end face of the rotor disk, it is there that the sealing elements, distributed around the circumference, are located. The sealing elements in this case, when acted upon by centrifugal force during rotation of the rotor, are supported on the rotor disk directly at the end of the sealing elements that faces toward the rotor axis. For this purpose, the rotor disk has a circumferential projection, which extends axially in front of the end face, and on which there is supported in each case a fastening shoulder that extends on the sealing element to the rotor disk is supported. In this case, a support surface that faces toward the rotor axis is almost necessarily formed on the projection of the rotor disk by a surface of revolution rotating about the rotor axis. The retaining surface of the fastening shoulder, which is in bearing contact with the support surface, is in principle designed to be complementary to the support surface, having a matching radius.

Further analogous designs are also known from EP 2344723 B1, EP 2414641 B1, EP 3077627 B1, EP 3090135 B1, EP 3129599, EP 3129600, EP 3167163 and EP 3227532, and in addition alternative mountings on the rotor disk are disclosed in EP 2399004 B1, EP 2426315 B1, EP 3077627 B1, EP 3090135 B1, EP 3129599, EP 3129600, EP 3167163 and EP 3227532, U.S. Pat. No. 9,109,457 B2, EP 3071795, EP 3019706, WO 2017174355 and WO 2017174723.

Although the fastening of the sealing elements to the rotor disk by means of the bearing contact of the fastening shoulder of the sealing elements on the retaining projection on the rotor disks has proven to be successful, loads close to the permissible material characteristics occur on the retaining projection and the fastening shoulder in the case of flow machines that have high power ratings.

In order to achieve a uniform bearing contact of the sealing element on the rotor disk, U.S. Pat. No. 4,304,523 proposes that the radii of the bearing contact surface on the rotor disk be made slightly larger than the radii of the complementary bearing contact surface on the sealing elements. Owing to the centrifugal force, an advantageous uniform compressive loading would result. In this case, however, it is necessary to take into account the angled shape of the proposed solution, which results in greater flexibility. Ff the sealing element is of a relatively straight design, however, the necessary flexibility is lacking, such that an opposite effect, with a greater loading in the middle of the component, can result.

SUMMARY OF INVENTION

The object of the present invention is therefore to realize a fastening of rotor components to a rotor disk in the case of large occurring centrifugal forces, wherein it is sought to achieve as uniform a compression as possible in the support of the rotor component.

The object presented is achieved by an embodiment according to the invention according to the teaching of the independent claim. A rotor component according to the invention for use in the case of a rotor according to the invention is also specified. Advantageous embodiments are provided by the dependent claims.

The rotor of the generic type serves, in particular, for use in the case of a gas turbine. However, the embodiment may also be used in the case of other types of rotor, for example in the case of steam turbines. At least, the rotor has at least one rotor disk, on which a plurality of rotor components are arranged, distributed around the circumference. The rotor in this case defines a rotor axis, and thus an axial direction.

For this purpose, the rotor disk has a circumferential, axially extending fastening shoulder. The circumferential fastening shoulder in this case forms a support surface on the side that faces toward the rotor axis. The support surface is a surface of revolution revolving about the rotor axis. As viewed in the axial direction, the support surface extends over the length on which the rotor component is in bearing contact with the fastening shoulder. According to the embodiment as a rotational solid, the support surface has a certain support radius, as a distance from the rotor axis, at a respective axial position. Furthermore, a central support radius of the support surface may be defined as the radius that is obtained in the center of the support surface in the axial direction.

In contrast, the rotor components each have a retaining shoulder, which extends in the circumferential direction and axially in relation to the rotor disk, and which is arranged on the side that faces toward the rotor axis beneath the fastening shoulder. The retaining shoulder in this case has a retaining surface that is complementary to the support surface. Like the support surface, the retaining surface also constitutes a portion of a surface of revolution. Accordingly, the retaining surface is defined as the surface of the retaining shoulder that comes into bearing contact with the fastening shoulder of the rotor disk. Similarly in this case, the retaining surface, as a surface of revolution, has a retaining radius at a respective axial position. Furthermore, a central retaining radius of the retaining surface may be determined, obtained in the center of the retaining surface in the axial direction.

As intended, the centrifugal forces occurring in the rotor component can thus be transferred, at least proportionately, to the fastening shoulder via the retaining shoulder, in the bearing contact of the retaining surface on the support surface.

Whereas, in the prior art, the retaining surface and the support surface are usually formed by a matching surface of revolution and, to that extent, the retaining radius and the support radius match, the retaining radius is now, according to the invention, realized so as to be smaller than the support radius. In respect of attainment of a highest load capacity, it has been shown in this case that that a retaining radius having at least 0.99 times the support radius and, at the same time, having a maximum of 0.9995 times the support radius is, according to the invention, of particular advantage as compared with the embodiments of the prior art. This means that a variation of the lesser support radius from the greater support radius by a maximum of 1% is permissible, the variation on the other hand being at least 0.5%.

The comparison of the support radius and the retaining radius is always effected at the same axial position, i.e. according to the bearing contact of the retaining surface on the support surface.

To enable a more or less straight-line design of the rotor component in the radial and the circumferential direction, it is further provided according to the invention that the rotor component is provided with an aperture extending axially through the rotor component. The aperture in this case is to be arranged radially outside the retaining shoulder, i.e. also outside the retaining surface. Furthermore, it is provided that the aperture extends in the circumferential direction over approximately half if the width of the rotor component. This is considered to be achieved if the width of the aperture is at least 0.25 times the width of the rotor component in the circumferential direction, but the width of the aperture is selected so as to be not greater than 0.75 times the width of the rotor component in the circumferential direction. The width in this case is that considered at the same radial position.

The design of the rotor component according to the invention, having a retaining radius that is selected so as to be slightly smaller than the support radius, when combined with the introduction of the aperture, results in the particular advantage of the high load capacity of the connection, according to the invention, between the retaining shoulder and the fastening shoulder. On the one hand, the aperture allows a high degree of deformation of the rotor component and, on the other hand, the deformation is compensated by the differing radii of the retaining surface and support surface. As a result, this makes it possible to achieve a more uniform bearing contact of the support surface on the retaining surface, with uniform compressive stresses, compared to attempting to determine an appropriate geometry without an aperture.

The realization of a rotor according to the invention by means of a configuration of the rotor component according to the invention, having a retaining shoulder that has a differing, smaller radius as compared with the support surface of the fastening shoulder on the rotor disk, and with the introduction of an aperture, creates at the same time a novel rotor component according to the invention that has the previously defined properties.

The configuration of the retaining shoulder of the rotor component is particularly advantageous if the retaining radius is selected so as to be at least 0.999 times the support radius. This results in an advantageous design, in particular when used in the case a gas turbine rotor.

The width of the aperture corresponding to approximately half of the width of the rotor component is achieved particularly advantageously if the aperture extends over at least 0.4 times the width of the rotor component in the circumferential direction. Similarly, it is particularly advantageous in this case if the aperture extends over maximally 0.6 times the width of the rotor component.

An advantageous stress distribution is achieved if the aperture becomes larger with increasing radius. For example, it may be provided that, when the rotor component is viewed in the axial direction, the two circumferentially opposite sides enclose an angle of approximately 45°. Accordingly, it is advantageous if the width increases from a first radial position to a second, greater radial position by at least 0.75 times the difference of the second radius and the first radius, i.e. $B2 >= B1 + 0.75 \times (R2 - RI)$. In contrast, however, the width should not increase too abruptly. For this purpose, the width should increase from a first radial position to a second larger radial position by not more than 1.25 times the difference of the second radius and the first radius, i.e. $B2 <= B1 + 1.25 \times (R2 - RI)$. In this consideration, generous rounding in the corners of the aperture are to be disregarded.

The support surface and the complementary retaining surface can be realized differently, as viewed in longitudinal section. In the simplest case, the surfaces in each case are cylindrical. This facilitates manufacture and ensures a defined position of the components relative to each other. A disadvantage of this design, however, is the stress distribution in the fastening shoulder and the retaining shoulder. Moreover, it is conceivable to realize the support surface and the complementary retaining surface such that they are convex or curved (along the axial direction). A disadvantage in this case, however, is the production of the surfaces with maintenance of very small tolerances. It has proved to be particularly advantageous, therefore, if the support surface and the complementary retaining surface are realized as a portion of a conical surface, i.e. are conical.

In the case of use of a conical support surface as well as a conical retaining surface, it is additionally advantageous if the opening angle of the defining cone is between 30° and 90°. Thus, the angle between the support surface, or the retaining surface, and the rotor axis is advantageously between 15° and 45°. The design of the fastening shoulder with the support surface, and of the fastening shoulder with the retaining surface, is particularly advantageous if an opening angle of at least 45° is selected. It is also particularly advantageous if the opening angle is maximally 75°.

Furthermore, it is also advantageous if the distance from the retaining shoulder to the aperture is not too great in relation to the width of the remaining web next to the aperture. Based on a web width as the distance from the aperture to the nearest side edge in the circumferential direction, and a reference point in the center of the retaining surface, it is therefore advantageous if the distance from the retaining surface to the aperture in the radial direction is not greater than the web width. It is particularly advantageous if the radial distance is between 0.25 and 0.75 times the web width.

The design of the rotor component according to the invention, having a retaining surface that has radius a slightly smaller than the support surface, in combination with an aperture, can be applied particularly advantageously if the rotor component has a substantially flat shape extending in the circumferential direction and radially. To that extent, when centrifugal force acts within the rotor component, it is predominantly tensile stresses, and only secondary bending stresses, that occur in the rotor component. For example, the tensile stresses in this case are at least twice as great as the bending stresses. The retaining shoulder in this case extends substantially in the axial direction.

For the purpose of fastening the rotor component to the rotor while supporting the centrifugal forces from the retaining shoulder to the fastening shoulder, it is also advantageous if the rotor component can be supported on the rotor, opposite the retaining shoulder, with an inner edge portion that faces toward the rotor axis. For this purpose, the rotor disk may optionally have a circumferential annular projection spaced apart from an end face of the rotor disk, or from the fastening shoulder. Alternatively, it may be provided that the corresponding annular projection is arranged on a second rotor disk adjacent to the rotor disk. At least the corresponding annular projection on the rotor disk, or the second rotor disk, realizes a bearing contact surface that faces toward the fastening shoulder, and against which the inner edge portion of the rotor components comes into bearing contact and can be supported in the axial direction.

The embodiment according to the invention is suitable, particularly advantageously, in the case of a rotor disk to which a plurality of rotor blades can be attached, distributed around the circumference. For this purpose, the rotor disk has a plurality of blade retaining slots distributed around the circumference and extending axially through the rotor disk. The blade retaining slots in this case are covered, at least portionally, on an end face of the rotor disk by the rotor components distributed around the circumference.

BRIEF DESCRIPTION OF THE DRAWINGS

Shown schematically in the following figures is an exemplary embodiment for a rotor in the region of the connection between a rotor component and a rotor disk. There are shown.

DETAILED DESCRIPTION OF INVENTION

Figure 1:
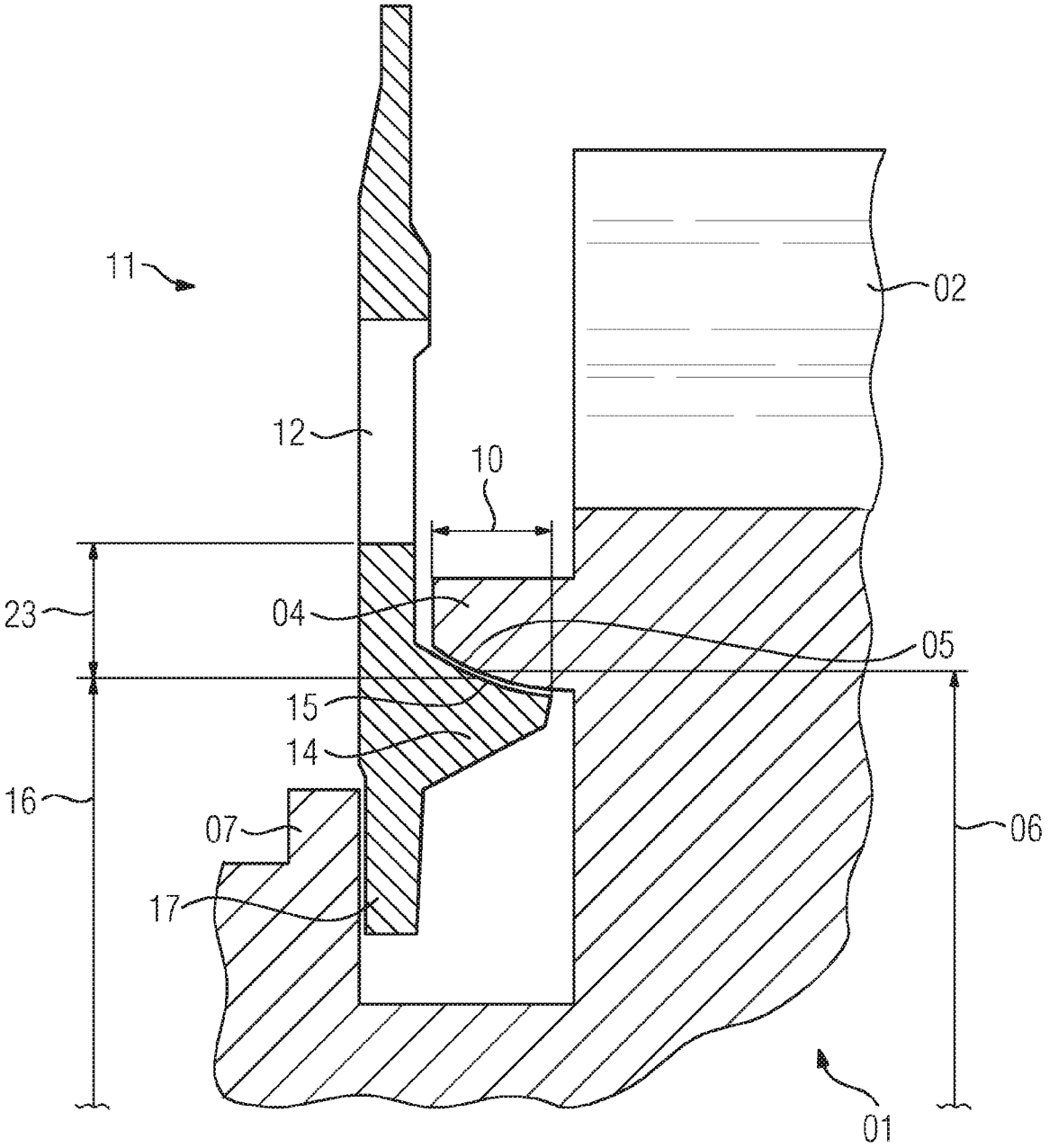
In FIG. 1, a portion of the rotor disk, and of the rotor component attached to it, is shown schematically in a longitudinal sectional view.

Shown schematically in FIG. 1 is a longitudinal section through the rotor axis, through the rotor disk 01 and the rotor component 11, in the region of the connection between the rotor component 11 and rotor disk 01. It shows the rotor disk 01, having with a blade retaining slot 02 located on the radially outer circumference. This 02 is intended to receive rotor blades (not represented here). The rotor disk 01 in this case has a fastening shoulder 04, which 04 extends in the circumferential direction and in the axial direction, and has a support surface 05 on the side that faces toward the rotor axis. In this exemplary embodiment, merely as an example, the support surface 05 is represented as being slightly inclined and slightly convex. As a rule, a conical form of the support surface may be selected as simple suitable shape. In addition, the rotor disk 01, at a distance from the fastening shoulder 04, has a circumferential annular projection 07 extending radially outward. To that extent, in this exemplary embodiment, a circumferential slot is formed beneath the fastening shoulder 04 and behind the annular projection 07.

Also shown is the rotor component 11, which 11 is fastened to the rotor disk 01. For this purpose, the rotor component 11 has a retaining shoulder 14, which 14 likewise extends in the circumferential direction and axially. Similarly, the retaining shoulder 14 forms a retaining surface 15, which 15 is arranged on the side that faces radially outward. In this case, the retaining surface 15 and the support surface 05 are realized so as to complement each other. The retaining shoulder 14 is arranged close to the end of the rotor component 11 that faces toward the rotor axis, an inner edge portion 17 being located at the end on the side that faces toward the rotor axis. This 17 in this case is in axial bearing contact with the annular projection 07 of the rotor disk 01. In the case of corresponding centrifugal forces due to the rotation of the rotor, the supporting of the rotor component 11 via the retaining shoulder 14, having the retaining surface 15, on the support surface 05 of the fastening shoulder 04 results in a moment in the rotor component 11 that is supported via the bearing contact of the inner edge portion 17 on the annular projection 07.

The geometries of the support surface 05 and of the retaining surface 15 are of essential importance, these surfaces bearing against each other over a bearing width 10, as viewed in the axial direction. This means that those surfaces of the fastening shoulder 04, or of the retaining shoulder 14, that are in bearing contact with each other over the bearing width 10 are regarded as a support surface 05 and the retaining surface 15. The support surface 05 in this case, as a surface of revolution about the rotor axis, has a supporting radius 06. In contrast, the retaining surface 15 of the rotor component 11, likewise realized as a portion of a surface of revolution, correspondingly has a retaining radius of 16. For the respective comparison, the support radius 06 and the retaining radius 16 are determined at the same axial position. It is then essential that the support radius 16 is less than the support radius 06, and thus the rotation axis of the support surface 15 is positioned at a distance apart from the rotor axis.

Furthermore, essential to the achievement of the object, the rotor component 11 has an aperture 12 that extends through the rotor component 11 in the axial direction. This 12 is arranged radially outside the retaining shoulder 14. Advantageously in this case, the aperture 12 is arranged at a certain central distance 23 in the radial direction from the center of the retaining surface 15.

Figure 2:
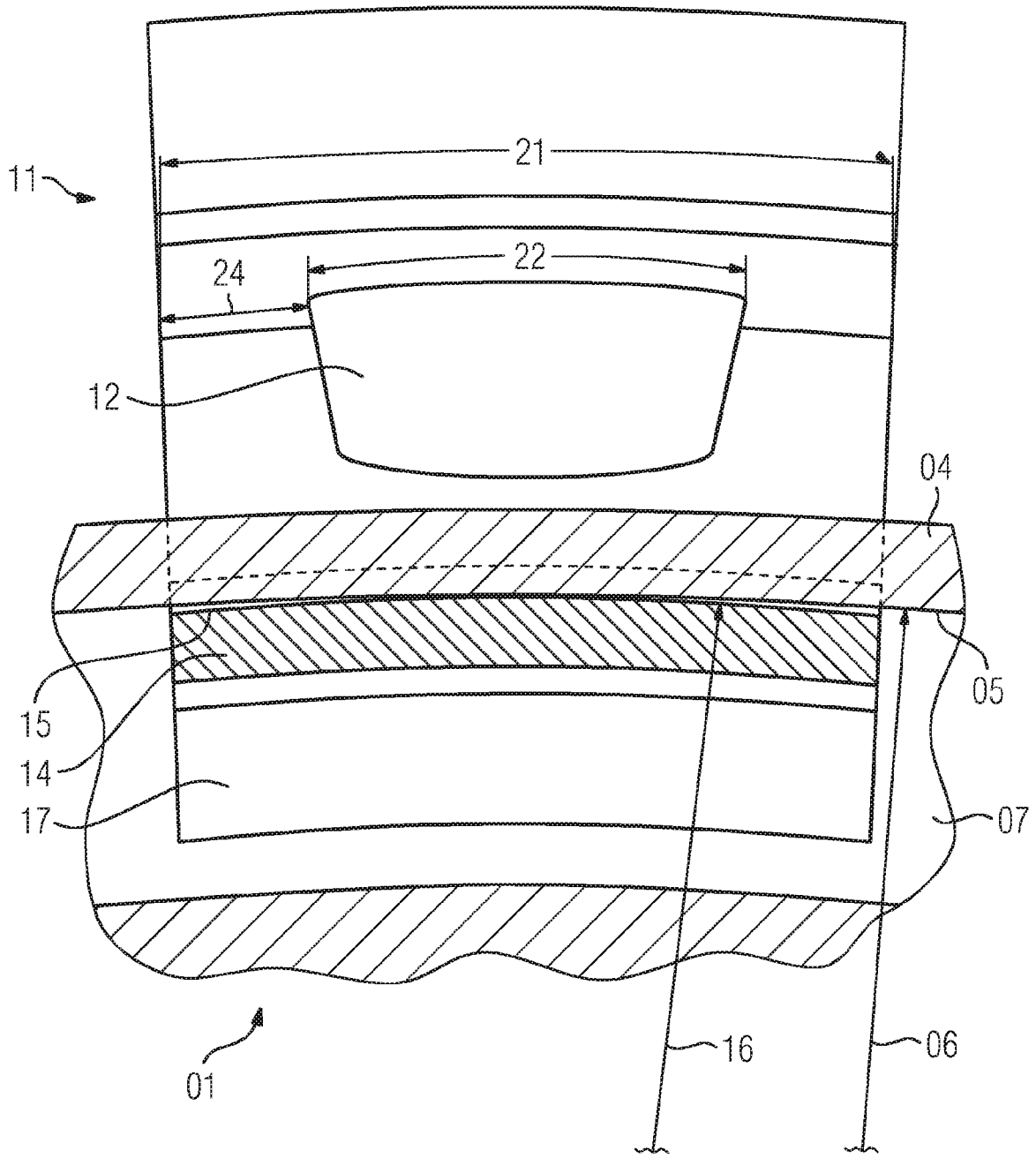
FIG. 2 shows the arrangement with the rotor disk and the rotor component in a section transverse to the rotor axis.

For this purpose FIG. 2 again shows schematically the arrangement with the rotor disk 01 and the rotor component 11, in a section transverse to the rotor axis, through the fastening shoulder 04 and the retaining shoulder 14, as viewed in the direction away from the rotor disk 01. In this case, the rotor component 11 can be seen with the inner edge portion 17, which 17 bears axially on the annular projection 07.

Essential now for the invention is consideration of the support surface 05, arranged on the fastening shoulder 04, on the side that faces toward the rotor axis, with the support radius 06 represented here in combination with the retaining shoulder 14, which 14 has the retaining surface 15, having the retaining radius 16, facing radially outward. It can be seen (shown in an exaggerated manner) that here it is provided that the retaining radius 16 has a lesser value than the opposite corresponding support radius 06.

This shape, with the retaining surface 15 not in full bearing contact with the support surface 05 as first viewed in circumferential direction, results in a uniform bearing contact stress between the two surfaces 05, 15 in the case of high centrifugal forces due to a corresponding rotation of the rotor.

Radially outside the retaining shoulder 14 is the aperture 12, two webs remaining on the rotor component, on both sides of the aperture 12. The aperture 12, for its part, contributes to the uniform bearing contact stress between the retaining surface 15 and the support surface 05. For this purpose, it is provided that the aperture 12 has a width 22 in the circumferential direction that corresponds approximately to half of the width 21 of the rotor component 11. Accordingly, webs having a web width 24 remain on both sides. With regard to the positioning of the aperture, it is advantageous in this case to take into account that the radial distance 23 from the center of the retaining surface 15 to the aperture 12 is not greater than the web width 24.

Furthermore, it can be seen that the aperture 12 widens with increasing radius. For optimum stress distribution, it is advantageous if the angle between the side flank of the aperture in the circumferential direction and the radial center axis is approximately 20°. Furthermore, it may advantageously be provided that generous roundings are provided at the upper end of the side flank and at the lower end of the side flank.

The invention claimed is:

1. A rotor comprising:

a rotor disk that has a circumferential fastening shoulder having a support surface that faces toward a rotor axis of the rotor and rotates about the rotor axis, and a plurality of rotor components distributed around the circumference, wherein each rotor component of the plurality of rotor components has a retaining shoulder having a retaining surface forming a portion of a surface of revolution that is complementary to the support surface, wherein in each cross section perpendicular to the rotor axis, the support surface has a support radius that is obtained in an axial midpoint of the support surface in an axial direction from the rotor axis and the retaining surface has a retaining radius that is obtained in an axial midpoint of the retaining surface in the axial direction from the rotor axis, wherein the retaining radius corresponds to at least 0.99 times and maximally 0.9995 times the support radius, and wherein the rotor component has an aperture radially outside the retaining surface, wherein the aperture has a width of at least 0.25 times and maximally 0.75 times the width of the rotor component in the circumferential direction.

2. The rotor as claimed in claim 1, wherein the retaining radius corresponds to at least 0.999 times the support radius.

3. The rotor as claimed in claim 1, wherein the width of the aperture corresponds to at least 0.4 times and maximally to 0.6 times the width of the rotor component in the circumferential direction.

4. The rotor as claimed in claim 1, wherein the aperture widens with increasing radius from the rotor axis in the radial direction, wherein the difference of the width in the circumferential direction is between 0.75 times and 1.25 times the difference in the radial direction.

5. The rotor as claimed in claim 1, wherein the support surface and the retaining surface are conical, wherein an opening angle of the cone is between 30° and 90°.

6. The rotor as claimed in claim 1, wherein the distance in the radial direction from the axial midpoint of the retaining surface to the aperture corresponds maximally to the distance from the aperture to an edge of the rotor component in the circumferential direction.

7. The rotor as claimed in claim 1, wherein the rotor component has a shape that extends substantially in the circumferential direction and radially, wherein the retaining shoulder extends in the axial direction.

8. The rotor as claimed in claim 1, wherein the rotor disk or a second rotor disk adjacent to the rotor disk have/has a circumferential annular projection spaced apart from the end face of the rotor disk, and the rotor component has an inner edge portion on the side that faces toward the rotor axis, wherein the inner edge portion is supported axially on the annular projection, opposite the retaining shoulder.

9. The rotor as claimed in claim 1, wherein the rotor disk has a plurality of blade retaining slots, distributed around the circumference, that extend through axially, and the rotor components cover the blade retaining slots, at least portionally, on an end face of the rotor disk.

10. A rotor component for use in a rotor, the rotor comprising a rotor disk that has a circumferential fastening shoulder having a support surface that faces toward a rotor axis of the rotor and rotates about the rotor axis, the rotor component comprising:

a retaining shoulder having a retaining surface forming a portion of a surface of revolution that is complementary to the support surface of the rotor disk, wherein in each cross section perpendicular to the rotor axis, the retaining surface has a retaining radius that is obtained in an axial midpoint of the retaining surface in the axial direction from the rotor axis, and an aperture arranged radially outside the retaining surface, wherein the aperture has a width of at least 0.25 times and maximally 0.75 times the width of the rotor component in the circumferential direction.

11. The rotor component as claimed in claim 10, wherein the width of the aperture corresponds to at least 0.4 times and maximally to 0.6 times the width in the circumferential direction.

12. The rotor component as claimed in claim 10, wherein the aperture widens with increasing radius from the rotor axis in the radial direction, wherein the difference of the width in the circumferential direction is between 0.75 times and 1.25 times the difference in the radial direction.

13. The rotor component as claimed in claim 10, wherein the retaining surface is conical, wherein an opening angle of the cone is between 30° and 90°.

14. The rotor component as claimed in claim 10, wherein the distance in the radial direction from the axial midpoint of the retaining surface to the aperture corresponds maximally to the distance from the aperture to the edge in the circumferential direction.

15. The rotor component as claimed in claim 10, wherein the rotor component has a shape that extends substantially in the circumferential direction and radially, wherein the retaining shoulder extends in the axial direction.

16. The rotor as claimed in claim 1, wherein the rotor component is a gas turbine rotor.

17. The rotor as claimed in claim 5, wherein the opening angle is between 45° and 75°.

18. The rotor component as claimed in claim 13, wherein the opening angle is between 45° and 75°.

* * * * *